US008016620B1

(12) United States Patent
Chiu et al.

(10) Patent No.: US 8,016,620 B1
(45) Date of Patent: Sep. 13, 2011

(54) ELECTRICAL CONNECTOR

(75) Inventors: Wen-Ta Chiu, Hsichih (TW); Ming-Hui Yen, Hsichih (TW); Wen-Shuan Shih, Hsichih (TW); Yi-Hao Su, Hsichih (TW)

(73) Assignee: Chant Sincere Co., Ltd., Hsichih, Taipei Hsien (TW)

( * ) Notice: Subject to any disclaimer, the term of this patent is extended or adjusted under 35 U.S.C. 154(b) by 0 days.

(21) Appl. No.: 12/851,974

(22) Filed: Aug. 6, 2010

(51) Int. Cl.
*H01R 24/00* (2011.01)

(52) U.S. Cl. ..... 439/660

(58) Field of Classification Search ..... 439/660, 439/607.4, 607.3, 607.56, 607.36
See application file for complete search history.

(56) References Cited

U.S. PATENT DOCUMENTS

2005/0048846 A1* 3/2005 Suzuki et al. ..... 439/660
2009/0124134 A1* 5/2009 Moriyama et al. ..... 439/660

* cited by examiner

*Primary Examiner* — Phuong Dinh

(74) *Attorney, Agent, or Firm* — Muncy, Geissler, Olds & Lowe, PLLC

(57) ABSTRACT

An electrical connector includes a connector body having an electrically insulative base block with a front vertical stop wall and a locating notch on the middle of front vertical stop wall, an electrically insulative front extension portion forwardly extended from the electrically insulative base block and conducting terminals mounted in the electrically insulative base block and the electrically insulative front extension portion, and a metal shielding shell surrounding the connector body and having a positioning block downwardly protruded from the top wall thereof and engaged into the locating notch of the electrically insulative base block of the connector body to assure connection stability between the connector body and the metal shielding shell and positive contact between the conducting terminals and an inserted external electrical connector.

8 Claims, 8 Drawing Sheets

ELECTRICAL CONNECTOR

BACKGROUND OF THE INVENTION

1. Field of the Invention

The present invention relates to electrical connectors and more particularly, to such an electrical connector, which prohibits structural damage or relative movement between the connector body and metal shielding shell thereof upon insertion of an external electrical connector, assuring structural stability and reliability.

2. Description of the Related Art

Following fast development of computer technology, notebook computers are intensively used to substitute for desk computers for the advantages of small size and high mobility. Further, when using a computer to transmit signal or data or connecting a computer to a peripheral apparatus, peripheral interface means is necessary.

To fit small-sized, light-weighted and mobile characteristics of advanced electronic apparatus, USB and Mini USB connectors are created. Mini USB connectors include A-type and B-type to fit different plug specifications. These connectors are commonly used in small electronic apparatus, such as digital camera, cell phone, card reader and multimedia player.

Further, following the development of computer toward the characteristics of small size, high operation speed and high image processing speed, the conventional CRT (cathode-ray-tube) displays have been gradually removed from the market. Nowadays, either big-scale desk type or mobile type, LCD display devices are commonly used. Display interface specifications have also changed from the early analog VGA (video graphics array) interface devices to the current full digital DVI interface devices, minimizing signal attenuation and distortion during digital signal conversion. However, DVI interface devices simply provide a limited bandwidth for big scale LCD display device. To eliminate this problem, HDMI (High-Definition Multimedia Interface) is developed. HDMI is a compact audio/video connector interface for transmitting uncompressed digital streams. Further, HDMI includes A type and B type to fit different plug specifications for connecting any of a variety of digital audio/video sources such as set-top boxes, disc players, personal computers, video game consoles, and AV receivers to compatible digital audio devices, computer monitors, and digital TVs.

FIG. 8 illustrates an electrical connector according to the prior art. According to this design, the electrical connector comprises an electrically insulative body A having a tongue plate A1 at the front side, a set of conducting terminals A2 arranged on the top and bottom sides of the tongue plate A1, and a metal shielding shell B surrounding the electrically insulative body A. The metal shielding shell B defines therein an insertion hole B1. Further, the metal shielding shell B has a plurality of retaining members B2 respectively engaged into respective retaining grooves A3 on the electrically insulative body A, and two ground pins B3 respectively outwardly extended from the two opposite lateral sides thereof. During application, the ground pins B3 of the metal shielding shell B and the rear bonding ends of the conducting terminals A2 are respectively bonded to a circuit board.

When in use, an external electrical connector is inserted into the insertion hole B1 of the metal shielding shell B and electrically connected to the conducting terminals A2 at the tongue plate A1 for signal transmission. Upon insertion of the external electrical connector is inserted into the insertion hole B1 of the metal shielding shell B, the inserted external electrical connector imparts a pressure to the front edge of the tongue plate A1. This pressure may cause the engagement between the retaining members B2 of the metal shielding shell B and the retaining grooves A3 of the electrically insulative body A to be loosened, resulting in structural instability, structural damage or contact error between the conducting terminals A2 and the inserted external electrical connector.

Further, the ground pins B3 are respectively outwardly extended from the two opposite lateral sides of the metal shielding shell B. When bonding the ground pins B3 to a circuit board, the solder material (solder paste) may flow along the inner surface of the ground pins B3 to the inside of the metal shielding shell B, lowering the bonding strength and causing accumulation of the solder material (solder paste) in the metal shielding shell B. When inserting an external electrical connector into the metal shielding shell B to connect the conducting terminals A2, or removing the inserted electrical connector from the conducting terminals A2 and the metal shielding shell B, the ground pins B3 may be disconnected from the circuit board, and the inserted external electrical connector may be jammed in the metal shielding shell B due to accumulation of the solder material (solder paste) in the metal shielding shell B.

Therefore, it is desirable to provide an electrical connector that eliminates the aforesaid problems.

SUMMARY OF THE INVENTION

The present invention has been accomplished to provide an electrical connector, which eliminates the drawbacks of the aforesaid prior art design. According to one aspect of the present invention, the electrical connector comprises a connector body and a metal shielding shell. The connector body comprises an electrically insulative base block, an electrically insulative front extension portion forwardly extended from the front side of the electrically insulative base block for insertion into an external electrical connector, and a plurality of conducting terminals mounted in the electrically insulative base block and the electrically insulative front extension portion. The electrically insulative base block has a front vertical stop wall abutted to the electrically insulative front extension portion and adapted for stopping against the front edge of the plug of an inserted external electrical connector, and a locating notch located on the middle part of the front vertical stop wall. The metal shielding shell surrounds the connector body, comprising a front insertion port for the insertion of an external electrical connector and a positioning block downwardly protruded from the top wall near the rear side thereof and engaged into the locating notch of the electrically insulative base block of the connector body. Further, the electrically insulative base block comprises a rear vertical stop wall disposed at the top side thereof opposite to the front vertical stop wall. Further, the metal shielding shell comprises two rear locating strips bilaterally extended from the top wall thereof and stopped against the rear vertical stop wall of the electrically insulative base block. When an external electrical connector is inserted into the metal shielding shell to connect the connector body, the front edge of the plug of the inserted external electrical connector will be stopped against the front vertical stop wall of the electrically insulative base block and the positioning block of the metal shielding shell that is positioned in the locating notch and kept in flush with the front vertical stop wall. Further, the locating strips are stopped against the rear vertical stop wall of the electrically insulative base block, the connection stability between the connector body and the metal shielding shell is enhanced, assuring structural reliability.

Further, the metal shielding shell comprises two bonding strips respectively downwardly extended from two opposite sidewalls thereof and respectively terminating in a respective flat ground pin at the bottom side for bonding to the ground contacts of a circuit board by SMT (surface mount technology). Because the inwardly curved bonding strips are disposed at the bottom side of the metal shielding shell, bonding the flat ground pins of the bonding strips to the ground contacts of a circuit board does not cause the solder material to flow along the inner surfaces of the flat ground pins into the inside of the metal shielding shell. Thus, the flat ground pins of the bonding strips can be positively bonded to the ground contacts of the circuit board, avoiding accidental disconnection of flat ground pins of the bonding strips from the ground contacts of the circuit board during insertion of an external electrical connector into the metal shielding shell, or jam of the inserted external electrical connector due to accumulation of excessive solder material (solder paste) in the metal shielding shell.

Further, the metal shielding shell comprises two raised portions respectively located on an inner surface of each of two opposite sidewalls thereof for friction engagement with an inserted external electrical connector. During insertion of an external electrical connector into the metal shielding shell, the two raised portions of the metal shielding shell are respectively stopped against the two opposite lateral sides of the plug of the inserted external electrical connector, minimizing friction between the external electrical connector and the inside wall of the metal shielding shell, and assuring insertion stability of the inserted external electrical connector.

DETAILED DESCRIPTION OF THE PREFERRED EMBODIMENT

Figure 1:
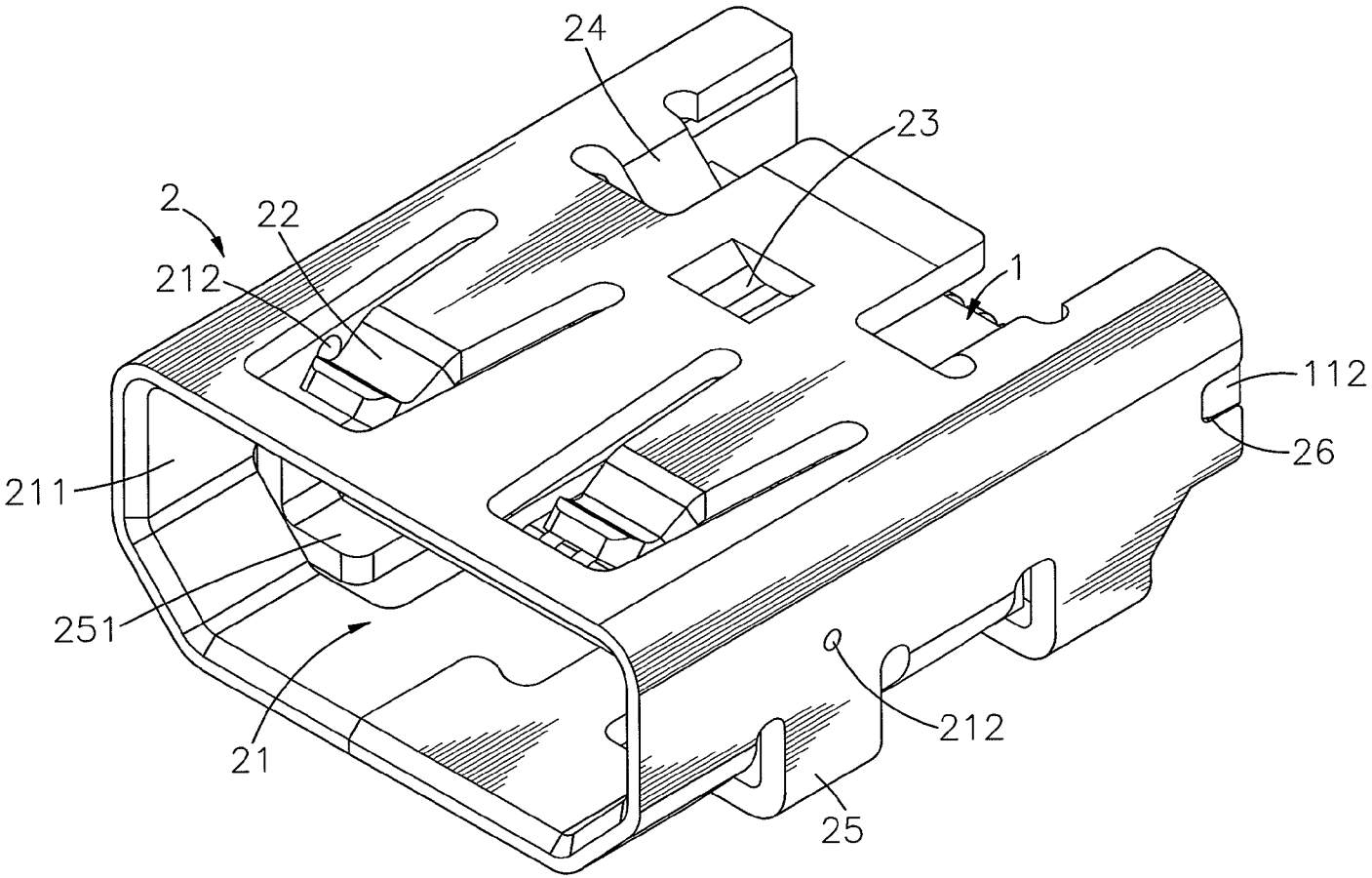
FIG. 1 is an elevational view of a metal shielding shell for electrical connector in accordance with the present invention.
Figure 2:
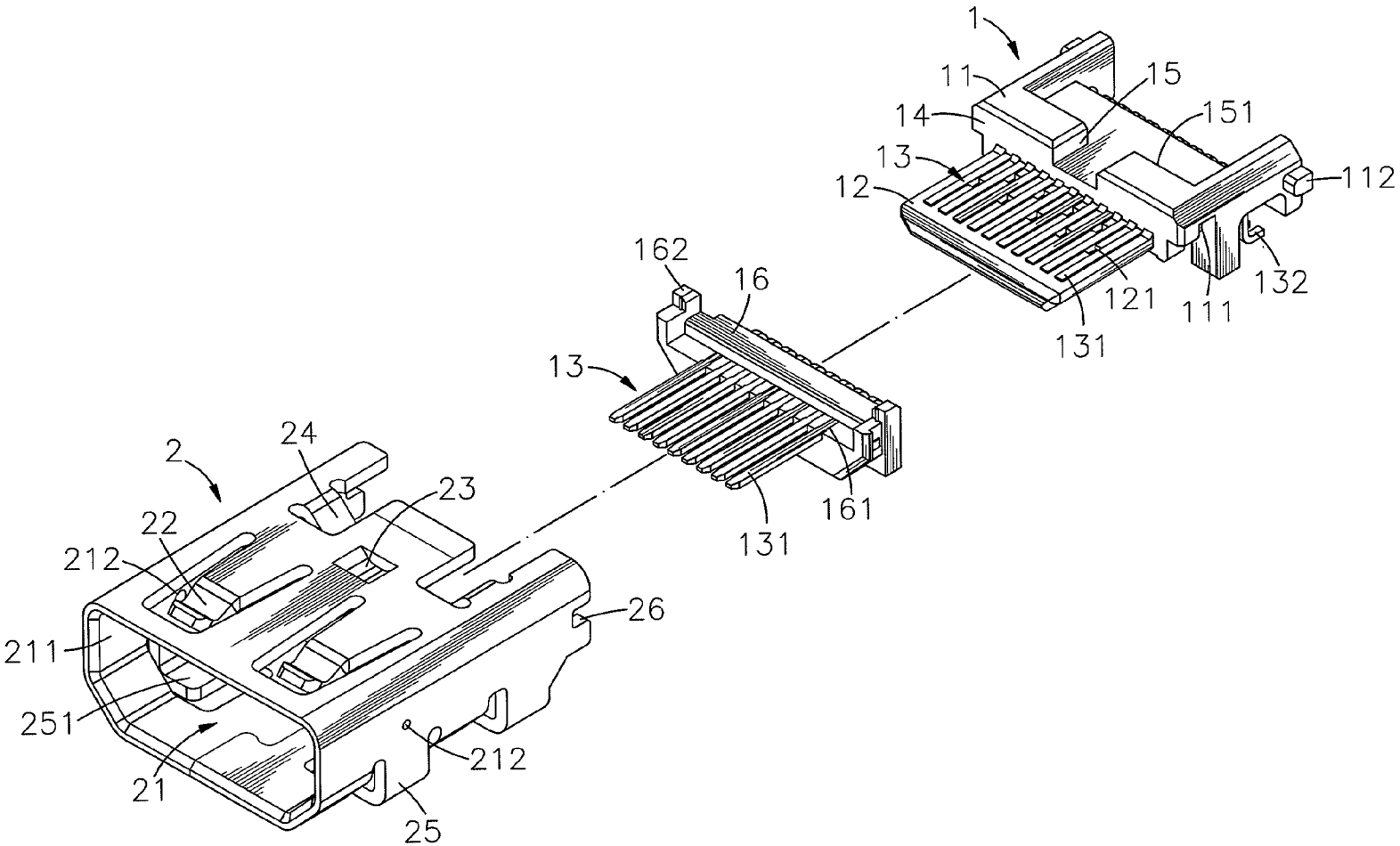
FIG. 2 is an exploded view of an electrical connector in accordance with the present invention.
Figure 3:
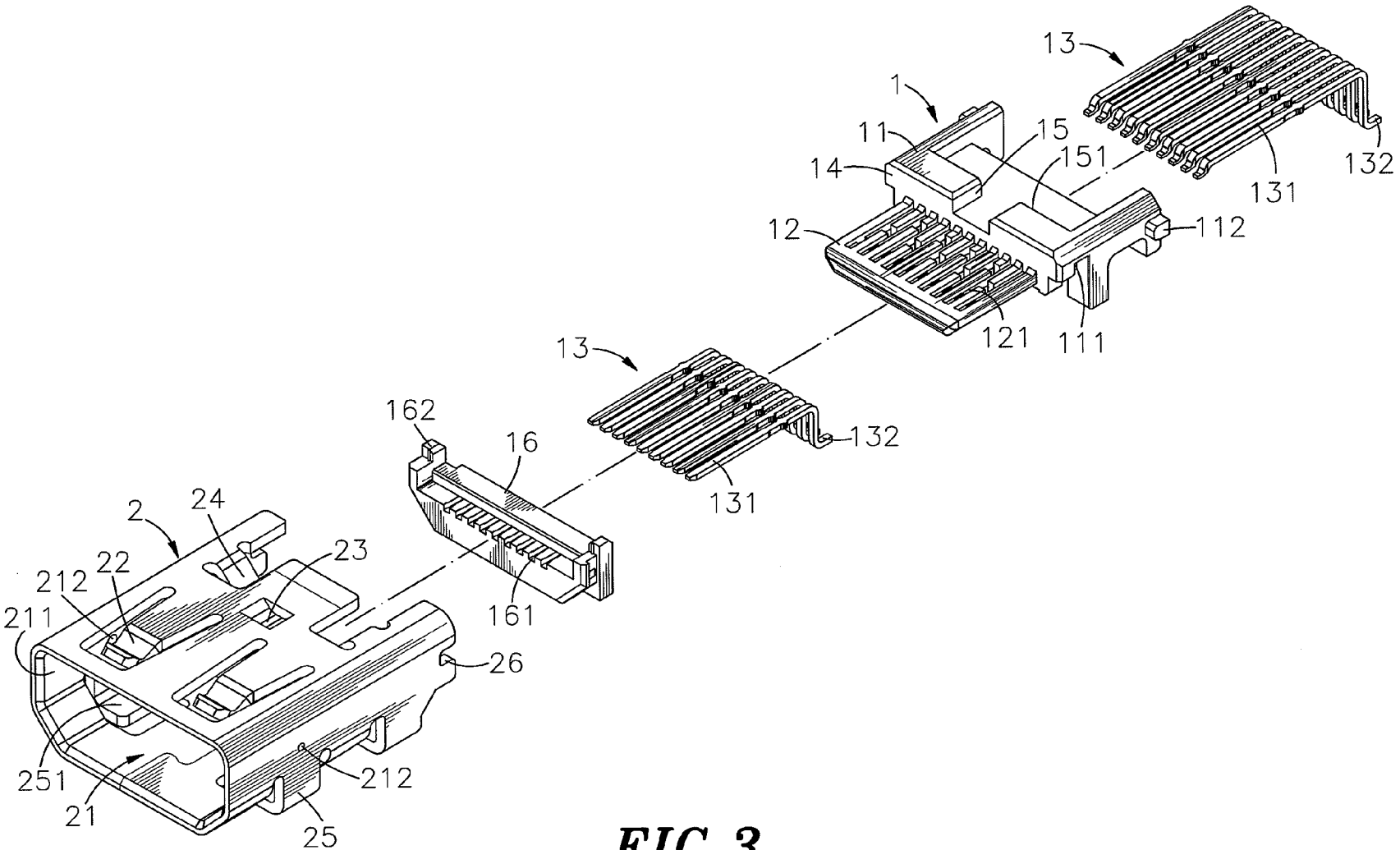
FIG. 3 is another exploded view of the electrical connector in accordance with the present invention.
Figure 4:
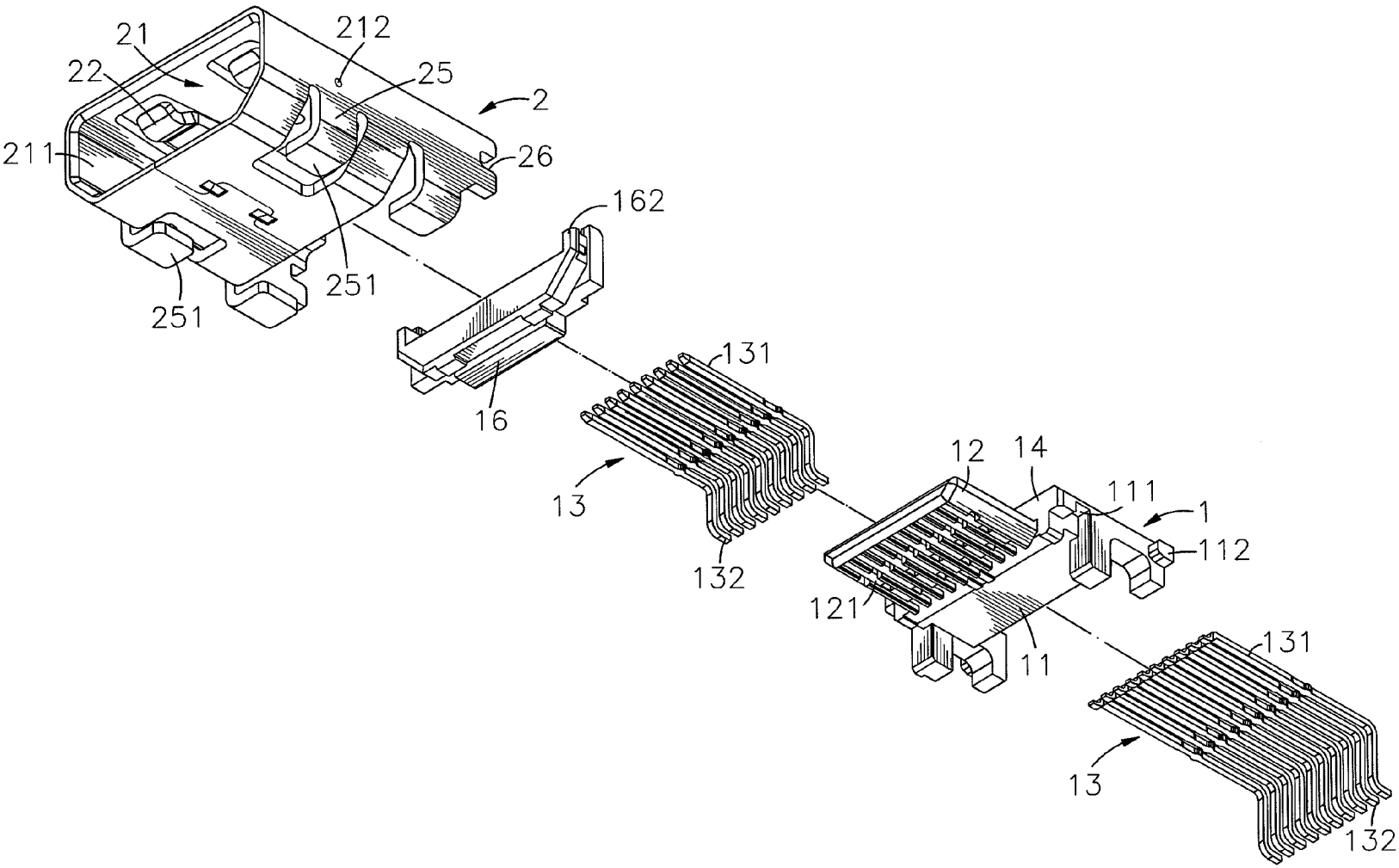
FIG. 4 corresponds to FIG. 3 when viewed from another angle.

Referring to FIGS. 1~4, an electrical connector in accordance with the present invention is shown comprising a connector body 1 and a metal shielding shell 2.

The connector body 1 comprises an electrically insulative base block 11, an electrically insulative front extension portion 12 forwardly extended from the front side of the electrically insulative base block 11 for insertion into an external electrical connector 3 that is inserted into the electrical connector of the present invention (see FIG. 7), a plurality of terminal grooves 121 arranged on the top and bottom sides of the electrically insulative front extension portion 12, and a plurality of conducting terminals 13 mounted in the electrically insulative base block 11 and respectively positioned in the terminal grooves 121 at the top and bottom sides of the electrically insulative front extension portion 12. The conducting terminals 13 each have a front contact portion 131 suspending outside the associating terminal groove 121 and a rear bonding portion 132 extended out of the electrically insulative base block 11 for bonding. Further, the electrically insulative base block 11 has a front vertical stop wall 14 abutted to the electrically insulative front extension portion 12 for stopping against the front edge of the plug 31 of the inserted external electrical connector 3, a locating notch 15 located on the middle of the front vertical stop wall 14, and a rear vertical stop wall 151 disposed at the top side thereof opposite to the front vertical stop wall 14.

The metal shielding shell 2 surrounds the connector body 1 for EMI (electromagnetic interference) protection, comprising an accommodation chamber 21, a front insertion port 211 located on the front side thereof in communication with the accommodation chamber 21 for the insertion of the external electric connector 3, for example, two retaining spring strips 22 forwardly downwardly protruded from the top wall thereof adjacent to the front insertion port 211, a positioning block 23 downwardly protruded from the top wall near the rear side thereof and engaged into the locating notch 15 of the connector body 1, two rear locating strips 24 bilaterally extended from the top wall and suspending in the accommodation chamber at the rear side, two bonding strips 25 respectively curved from the two opposite sidewalls thereof toward the bottom side of the accommodation chamber 21 and respectively terminating in a respective flat ground pin 251.

Further, the electrically insulative base block 11 of the connector body 1 has two locating grooves 111 bilaterally located on the bottom side thereof. Further, an electrically insulative partition plate 16 is attached to the bottom side of the electrically insulative base block 11 of the connector body 1, having two stepped mounting flanges 162 respectively engaged into the locating grooves 111 of the electrically insulative base block 11 of the connector body 1 and a plurality of terminal slots 161 for the passing of the front contact portions 131 of the conducting terminals 13 that are positioned in the associating terminal groove 131 at the bottom side of the electrically insulative front extension portion 12 of the connector body 1. Further, the electrically insulative base block 11 of the connector body 1 has two locating rods 112 respectively protruded from the two opposite sidewalls thereof near the rear side and respectively engaged into a respective locating notch 26 at the rear side of each of the two opposite sidewalls of the metal shielding shell 2. Further, the metal shielding shell 2 has two raised portions 212 respectively located on the inner surface of each of the two opposite sidewalls thereof for friction engagement with the periphery of the plug 31 of the inserted external electrical connector 3.

According to the present preferred embodiment, the electrically insulative partition plate 16 is detachably fastened to the electrically insulative base block 11 of the connector body 1, and the conducting terminals 13 are detachably installed in the electrically insulative base block 11, electrically insulative front extension portion 12 and electrically insulative partition plate 16 of the connector body 1. Alternatively, the electrically insulative partition plate 16 can be formed integral with a part of the electrically insulative base block 11 of the connector body 1, and the conducting terminals 13 can be directly molded in the electrically insulative base block 11, electrically insulative front extension portion 12 and electrically insulative partition plate 16 by means of insert molding.

During installation of the present invention, sleeve the metal shielding shell 2 onto the connector body 1 to force the locating notches 26 of the metal shielding shell 2 into engagement with the respective locating rods 112 of the electrically insulative base block 11 and to engage the positioning block 23 of the metal shielding shell 2 into the locating notch 15 of the electrically insulative base block 11, and then bend the locating strips 24 downwardly toward the inside of the accommodation chamber 21 to have the locating strips 24 be stopped against the rear vertical stop wall 151 of the electrically insulative base block 11. At this time, the electrically insulative front extension portion 12 is suspending in the accommodation chamber 21 and front insertion port 211 of the metal shielding shell 2. Subject to the arrangement of the conducting terminals 13 in the top and bottom sides of the electrically insulative front extension portion 12 and the arrangement of the electrically insulative front extension portion 12 in the front insertion port 211 of the metal shielding shell 2, the electrical connector is in conformity with the specification of a Mini USB A/B type or HDMI socket.

Figure 5:
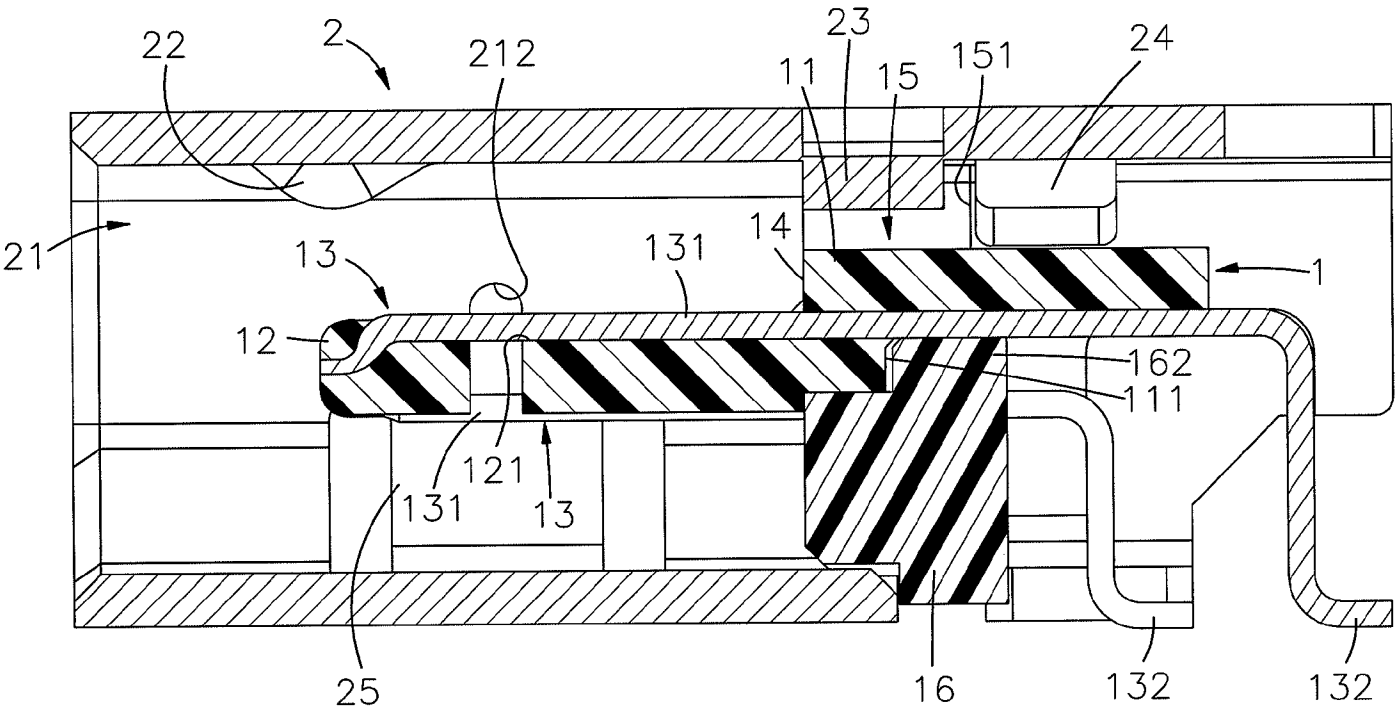
FIG. 5 is a schematic sectional side view of the electrical connector in accordance with the present invention (I).
Figure 6:
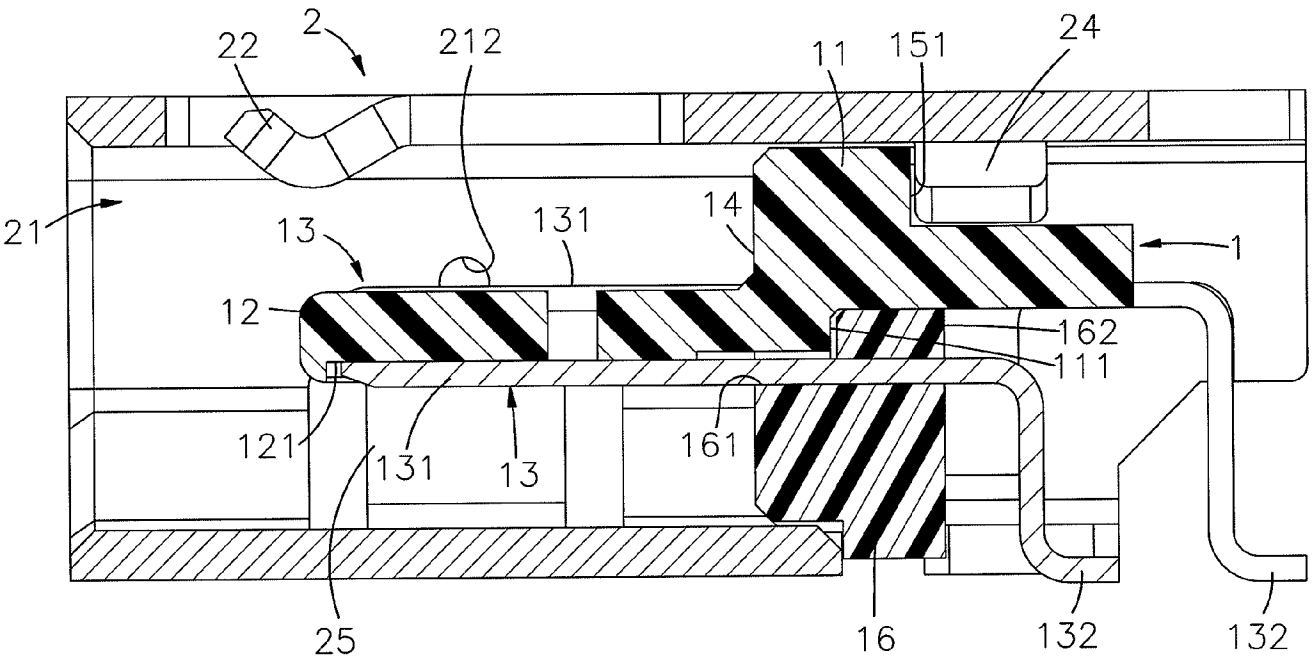
FIG. 6 is a schematic sectional side view of the electrical connector in accordance with the present invention (II).
Figure 7:
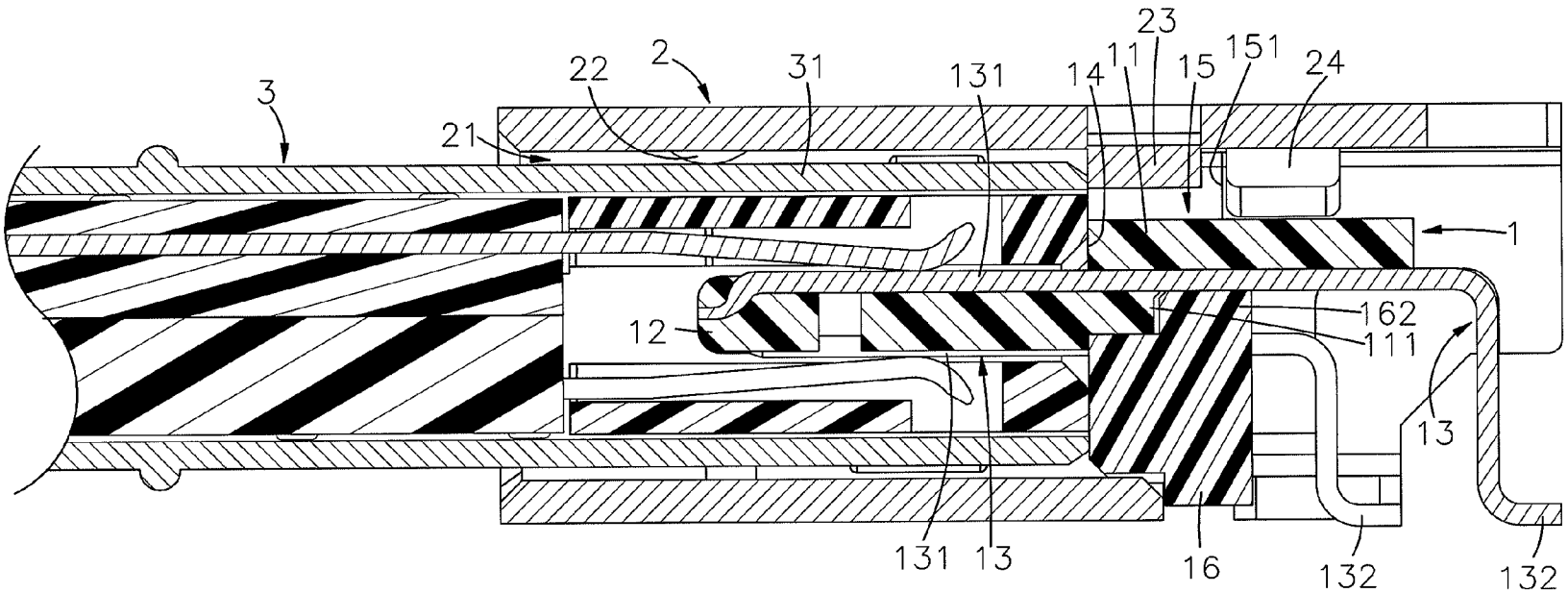
FIG. 7 is a schematic sectional view of the present invention, showing an external electrical connector connected thereto.
Figure 8:
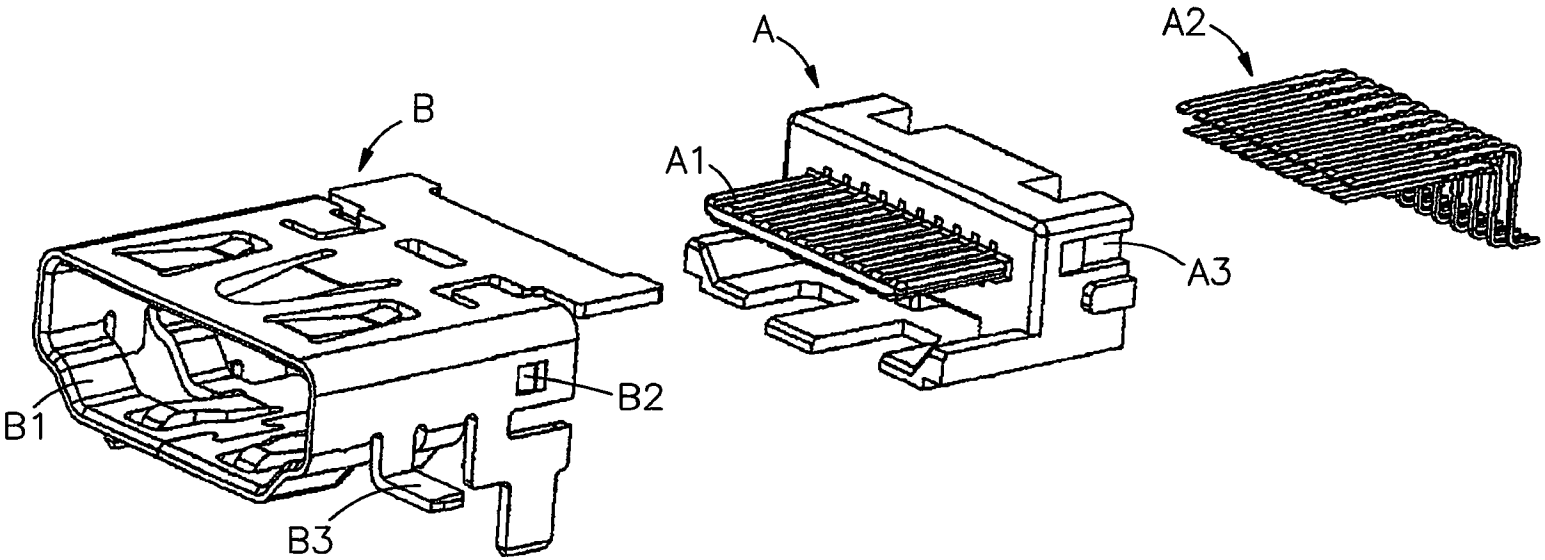
FIG.8 Prior Art
FIG. 8 is an exploded view of an electrical connector according to the prior art.

Referring to FIGS. 5~7 and FIGS. 2 and 4 again, during application of the electrical connector of the present invention, the bonding strips 25 of the metal shielding shell 2 are attached to a circuit board (not shown) to stop the flat ground pins 251 against a respective ground contact at the circuit board, and then the flat ground pins 251 of the bonding strips 25 of the metal shielding shell 2 are bonded to the ground contacts of the circuit board by SMT (surface mount technology). Because the inwardly curved bonding strips 25 are disposed at the bottom side of the metal shielding shell 2, bonding the flat ground pins 251 of the bonding strips 25 of the metal shielding shell 2 to the ground contacts of the circuit board does not cause the solder material to flow along the inner surfaces of the flat ground pins 251 into the inside of the accommodation chamber 21. Further, the inwardly curved bonding strips 25 keep the flat ground pins 251 in horizontal for positive bonding to the ground contacts of the circuit board, increasing the bonding surface area between the flat ground pins 251 of the bonding strips 25 and the ground contacts of the circuit board. Thus, the flat ground pins 251 of the bonding strips 25 can be positively bonded to the ground contacts of the circuit board, avoiding accidental disconnection of flat ground pins 251 of the bonding strips 25 from the ground contacts of the circuit board during insertion of an external electrical connector 3 into the front insertion port 211 of the metal shielding shell 2 to connect to the connector body 1, or jam of the inserted external electrical connector 3 due to accumulation of excessive solder material (solder paste) in the accommodation chamber 21.

When inserting an external electrical connector 3 into the front insertion port 211 of the metal shielding shell 2, the front edge of the plug 31 of the inserted external electrical connector 3 will be stopped against the front vertical stop wall 14 of the electrically insulative base block 11 and the positioning block 23 of the metal shielding shell 2 that is positioned in the locating notch 15 and kept in flush with the front vertical stop wall 14. Further, because the locating strips 24 are stopped against the rear vertical stop wall 151 of the electrically insulative base block 11, the connector body 1 will not be forced to move relative to the metal shielding shell 2 when the plug 31 of the inserted external electrical connector 3 is inserted into the accommodation chamber 21 and stopped against the front vertical stop wall 14 of the electrically insulative base block 11, assuring structural stability and reliability.

During insertion of the external electrical connector 3 into the front insertion port 211 of the metal shielding shell 2, the two raised portions 212 of the metal shielding shell 2 are respectively stopped against the two opposite lateral sides of the plug 31 of the inserted external electrical connector 3, minimizing friction between the external electrical connector 3 and the inside wall of the metal shielding shell 2, and assuring insertion stability of the inserted external electrical connector 3. After the inserted external electrical connector 3 has been set into position, the retaining spring strips 22 are engaged into respective retaining holes (not shown) on the plug 31 of the inserted external electrical connector 3, and the front contact portions 131 of the conducting terminals 13 of the connector body 1 are respectively kept in contact with the associating conducting terminals (not shown) of the inserted external electrical connector 3 for signal transmission. During signal transmission, the metal shielding shell 2 guides surrounding magnetic waves and internal noises to the grounding terminal of the circuit board, avoiding signal interference.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. An electrical connector, comprising:

a connector body, said connector body comprising an electrically insulative base block, an electrically insulative front extension portion forwardly extended from a front side of said electrically insulative base block for insertion into an external electrical connector, a plurality of conducting terminals mounted in said electrically insulative base block and said electrically insulative front extension portion, said electrically insulative base block having a front vertical stop wall abutted to said electrically insulative front extension portion and adapted for stopping against a front edge of a plug of an inserted external electrical connector and a locating notch located on a middle part of said front vertical stop wall; and a metal shielding shell surrounding said connector body, said metal shielding shell comprising a front insertion port for the insertion of an external electrical connector and a positioning block downwardly protruded from a top wall near a rear side thereof and engaged into said locating notch of said electrically insulative base block of said connector body.

2. The electrical connector as claimed in claim 1, wherein said electrically insulative front extension portion of said connector body comprises a plurality of terminal grooves arranged on top and bottom sides thereof; said conducting terminals are mounted in said electrically insulative base block and respectively positioned in said terminal grooves of said electrically insulative front extension portion, each said conducting terminal having a front contact portion suspending outside the associating terminal groove and a rear bonding portion extended out of said electrically insulative base block for bonding to an external circuit board.

3. The electrical connector as claimed in claim 2, wherein said connector body further comprises an electrically insulative partition plate located on a bottom side of said electrically insulative base block, said electrically insulative partition plate having a plurality of terminal slots for the passing of a number of said conducting terminals.

4. The electrical connector as claimed in claim 3, wherein said electrically insulative base block comprises two locating grooves bilaterally located on a bottom wall thereof; said electrically insulative partition plate comprises two stepped mounting flanges respectively engaged into the locating grooves of said electrically insulative base block.

5. The electrical connector as claimed in claim 1, wherein said electrically insulative base block comprises a rear vertical stop wall disposed at a top side thereof opposite to said front vertical stop wall; said metal shielding shell comprises two rear locating strips bilaterally extended from the top wall thereof and stopped against the rear vertical stop wall of said electrically insulative base block.

6. The electrical connector as claimed in claim 1, wherein said electrically insulative base block of said connector body comprises two locating rods respectively protruded from two opposite sidewalls thereof; said metal shielding shell comprises two locating notches bilaterally located on a rear side thereof and respectively and respectively forced into engagement with the locating rods of said electrically insulative base block.

7. The electrical connector as claimed in claim 1, wherein said metal shielding shell comprises an accommodation chamber disposed in communication with said front insertion port and adapted for accommodating said connector body, and two raised portions respectively located on an inner surface of each of two opposite sidewalls thereof for friction engagement with an inserted external electrical connector.

8. The electrical connector as claimed in claim 1, wherein said metal shielding shell comprises two bonding strips respectively downwardly extended from two opposite sidewalls thereof and respectively terminating in a respective flat ground pin at a bottom side thereof.

* * * * *